US010240379B2

(12) United States Patent
Salice

(10) Patent No.: US 10,240,379 B2
(45) Date of Patent: Mar. 26, 2019

(54) HINGE FOR PIECES OF FURNITURE WITH DEACTIVATABLE DECELERATION DEVICE

(71) Applicant: ARTURO SALICE S.P.A., Novedrate (IT)

(72) Inventor: Luciano Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 15/538,835

(22) PCT Filed: Dec. 11, 2015

(86) PCT No.: PCT/EP2015/079474

§ 371 (c)(1),
(2) Date: Jun. 22, 2017

(87) PCT Pub. No.: WO2016/102216

PCT Pub. Date: Jun. 30, 2016

(65) Prior Publication Data

US 2018/0010378 A1 Jan. 11, 2018

(30) Foreign Application Priority Data

Dec. 23, 2014 (IT) ..... MI2014A2227

(51) Int. Cl.
*E05F 1/08* (2006.01)
*E05F 5/00* (2017.01)
*E05D 3/14* (2006.01)

(52) U.S. Cl.
CPC ..... *E05F 5/006* (2013.01); *E05D 3/142* (2013.01); *E05Y 2201/214* (2013.01); *E05Y 2900/20* (2013.01)

(58) Field of Classification Search
CPC ..... E05Y 2900/20; E05Y 2900/202; E05Y 2900/204; E05Y 2201/20; E05Y 2201/21;
(Continued)

(56) References Cited

U.S. PATENT DOCUMENTS 8,505,165 B2 * 8/2013 Domenig ..... E05F 5/006 16/286
8,561,262 B1 * 10/2013 Liang ..... E05F 5/006 16/286

(Continued)

FOREIGN PATENT DOCUMENTS

AT 509720 A4 11/2011
CN 102257237 A 11/2011

(Continued)

OTHER PUBLICATIONS

International Search Report and Written Opinion dated Feb. 19, 2016 issued in PCT/EP2015/079474.

(Continued)

*Primary Examiner* — Chuck Y Mah
(74) *Attorney, Agent, or Firm* — Scully, Scott, Murphy & Presser, P.C.

(57) ABSTRACT

A hinge for pieces of furniture with deceleration device, comprising a fixed part which is adapted to be connected to the body of a piece of furniture, a moveable part which is adapted to be connected to a leaf of the piece of furniture, the fixed part and the movable part being mutually articulated by way of at least one connecting oscillating rocker, a decelerator being further provided; the decelerator comprises elements for at least partial deactivation of deceleration, which are adapted to uncouple the rocker from the decelerator.

12 Claims, 5 Drawing Sheets

(58) Field of Classification Search
CPC .. E05F 5/006; E05F 5/02; E05F 5/027; E05D 11/1021; E05D 11/1042; E05D 11/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 9,163,447 | B1* | 10/2015 | Liang | E05F 5/006 |
| 2004/0103499 | A1* | 6/2004 | Egger | E05D 11/087 16/242 |
| 2007/0136990 | A1* | 6/2007 | Salice | E05D 5/08 16/282 |
| 2008/0276426 | A1* | 11/2008 | Salice | E05D 11/1021 16/333 |
| 2009/0119875 | A1* | 5/2009 | Migli | E05F 5/006 16/233 |
| 2011/0019946 | A1* | 1/2011 | Krammer | E05F 5/006 384/20 |
| 2011/0298349 | A1* | 12/2011 | Sutterlutti | E05F 5/006 312/326 |
| 2012/0036678 | A1* | 2/2012 | Pecar | E05F 5/006 16/250 |
| 2012/0174338 | A1* | 7/2012 | Wu | E05F 5/006 16/297 |
| 2013/0139353 | A1* | 6/2013 | Brunnmayr | E05F 5/006 16/319 |
| 2013/0145580 | A1 | 6/2013 | Brunnmayr | |
| 2013/0160242 | A1* | 6/2013 | Brunnmayr | E05F 5/006 16/286 |
| 2014/0345081 | A1* | 11/2014 | Salice | E05F 5/006 16/50 |
| 2014/0352111 | A1* | 12/2014 | Ng | E05F 5/006 49/381 |
| 2015/0068126 | A1* | 3/2015 | Forster | E05F 5/006 49/381 |

FOREIGN PATENT DOCUMENTS

| | | | |
|---|---|---|---|
| CN | 103518030 | A | 1/2014 |
| CN | 103711393 | A | 4/2014 |
| EP | 1809843 | B1 | 2/2008 |
| EP | 2016246 | B1 | 3/2012 |
| EP | 2746509 | A1 | 6/2014 |
| WO | WO 2009/059662 | A1 | 5/2009 |
| WO | WO 2009/124332 | A1 | 10/2009 |
| WO | WO 2011/160889 | A1 | 12/2011 |

OTHER PUBLICATIONS

Italian Search Report and Written Opinion dated Aug. 18, 2015 issued in IT MI20142227, with partial translation.
Chinese Office Action dated May 23, 2018 received in Chinese Patent Application No. 201580070425.2, together with an English-language translation.

* cited by examiner

HINGE FOR PIECES OF FURNITURE WITH DEACTIVATABLE DECELERATION DEVICE

BACKGROUND OF THE DISCLOSURE

The present invention relates to a hinge for pieces of furniture with deactivatable deceleration device. More specifically, the invention relates to a hinge for pieces of furniture with a special deceleration device that makes it possible to be activated or at least partially deactivated according to the requirements of the user.

As is known, in the furniture sector, in order to support in an oscillating manner the door leaves of pieces of furniture, usually hinges are used that comprise a fixed part which can be connected to the body of the piece of furniture and a moveable part, constituted by a box, which can be connected to the door leaf, such parts being mutually articulated by way of a system of articulation that comprises connecting oscillating rockers.

In order to maintain the door leaf in the closed position, the hinges further comprise adapted elastic means, for example in the form of a V-shaped leaf spring which is loaded to push the arm of the fixed part, or the system of articulation, in the direction of closure of the hinge.

In order to decelerate the closing movement of the hinge imparted by the aforementioned elastic means, a deceleration device can be provided, for example of the fluid-operated linear type or the grease-operated rotary type.

Such deceleration device is particularly useful because it anticipates that the user can, by closing the door leaf with a brusque movement, cause a forceful impact of the door leaf against the structure of the piece of furniture, with consequent unwanted noise as well as potential damage to the door leaf proper.

EP1809843 and WO2011/160889 disclose deceleration devices of the rotary type, in particular WO2011/160889 discloses a deceleration device of the grease-operated rotary type, which, in the form of an assembly, can be assembled in a straightforward manner on an outer side of the bottom side walls of the hinge box. Such device has a deceleration disk which is actuatable by way of a slideable actuation element and a cam which is integral with one of the oscillating rockers of the hinge.

Furthermore, conventional deceleration devices can be optionally provided with means of deactivation of the deceleration function, so as to allow the installer and/or user to set how many of the hinges arranged on each door leaf have to be made to operate in decelerated mode, so as to optimize the closing movement of the door leaf, as a function of the weight and of the size characteristics of that door leaf.

Such deactivation means are for example disclosed in WO2009/124332 and comprise a locking element which is controllable manually or by way of a tool in order to lock the element (oscillating, in this case) for actuating the deceleration device at the end of the deceleration travel, so as to prevent the deceleration device from rearming, therefore deactivating the operation thereof.

However, a solution like the one proposed above is not applicable to hinges of the type illustrated in EP1809843 or in WO2011/160889, in that the slideable actuation element, being moveable integrally with the rocker of the hinge by way of the cam, cannot be locked in a stroke limit position.

BRIEF SUMMARY OF THE DISCLOSURE

The aim of the present invention is to provide a decelerated hinge for door leaves of pieces of furniture, which is provided with means for deactivating the deceleration function which are adapted to at least partially deactivate the deceleration function, and which can be used to deactivate a deceleration device of the type that comprises a slideable actuation element that can move integrally with a moveable part of the hinge, in particular with one of the rockers.

Within this aim, an object of the present invention is to provide a hinge for pieces of furniture with deactivatable deceleration device, in which the deactivation can be adjusted at the user's will.

Another object of the present invention is to provide a hinge for pieces of furniture with deactivatable deceleration device which is highly reliable, easily and practically implemented and low cost.

This aim and these and other objects which will become better apparent hereinafter are achieved by a hinge for pieces of furniture with deceleration device, comprising a fixed part which is adapted to be connected to the body of a piece of furniture, a moveable part which is adapted to be connected to a leaf of said piece of furniture, said fixed part and said movable part being mutually articulated by way of at least one connecting oscillating rocker, deceleration means being further provided which are coupled functionally to said oscillating rocker, characterized in that said deceleration means comprise means for at least partial deactivation of deceleration, said means for at least partial deactivation of deceleration being adapted to uncouple said oscillating rocker from said deceleration means.

BRIEF DESCRIPTION OF THE FIGURES

Further characteristics and advantages of the invention will become better apparent from the description of preferred, but not exclusive, embodiments of the hinge for pieces of furniture according to the present invention, which are illustrated by way of non-limiting example in the accompanying drawings, wherein.

DETAILED DESCRIPTION OF THE DISCLOSURE

Figure 1:
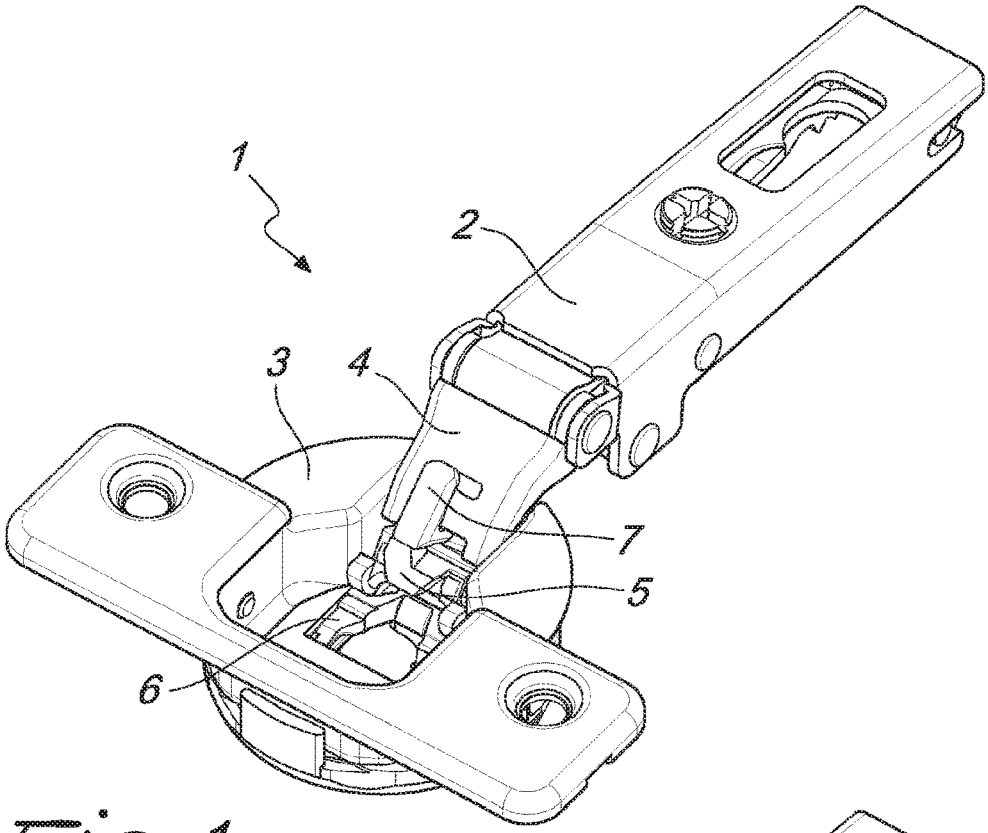
FIG. 1 is a perspective view of the hinge according to the invention with the deactivation device in the deceleration activation position.

With reference to the figures, the hinge according to the invention, generally designated by the reference numeral 1, comprises a fixed part 2 or arm of the hinge, which can be connected to the body of a piece of furniture, and a moveable part 3, which is constituted by a box and can be connected to the door leaf of the piece of furniture. The fixed part 2 and the moveable part 3 are mutually connected by way of a system of articulation that comprises at least one oscillating rocker 4, preferentially a first rocker 4 and a second rocker 9 which define an articulated quadrilateral kinematic mechanism together with respective pins 10, 11; 12, 13 for articulation to the moveable part 3 and to the fixed part 2 of the hinge.

The hinge according to the invention has means of deceleration which comprise a deceleration disk 8 which interacts with viscous means and is actuated by an actuation element 6, preferentially slideable, which can conveniently be functionally mated to or uncoupled from the rocker 4.

In particular, the coupling between the actuation element 6 and the rocker 4 occurs by way of adapted cam means 5 which are supported so that they can oscillate on the oscillation pin 10 between the rocker 4 and the box 3 and can be made integral or otherwise with the rocker 4.

The coupling between the cam means 5 and the rocker 4 occurs by way of means 7 for at least partial deactivation of deceleration, which comprise an element for locking the cam 5, such locking element being supported so that it can move on the rocker 4.

In a first embodiment, illustrated in FIGS. 1 to 5, the deactivation means 7 are supported so that they are linearly slideable, transversely, with respect to the rocker 4.

Figure 2:
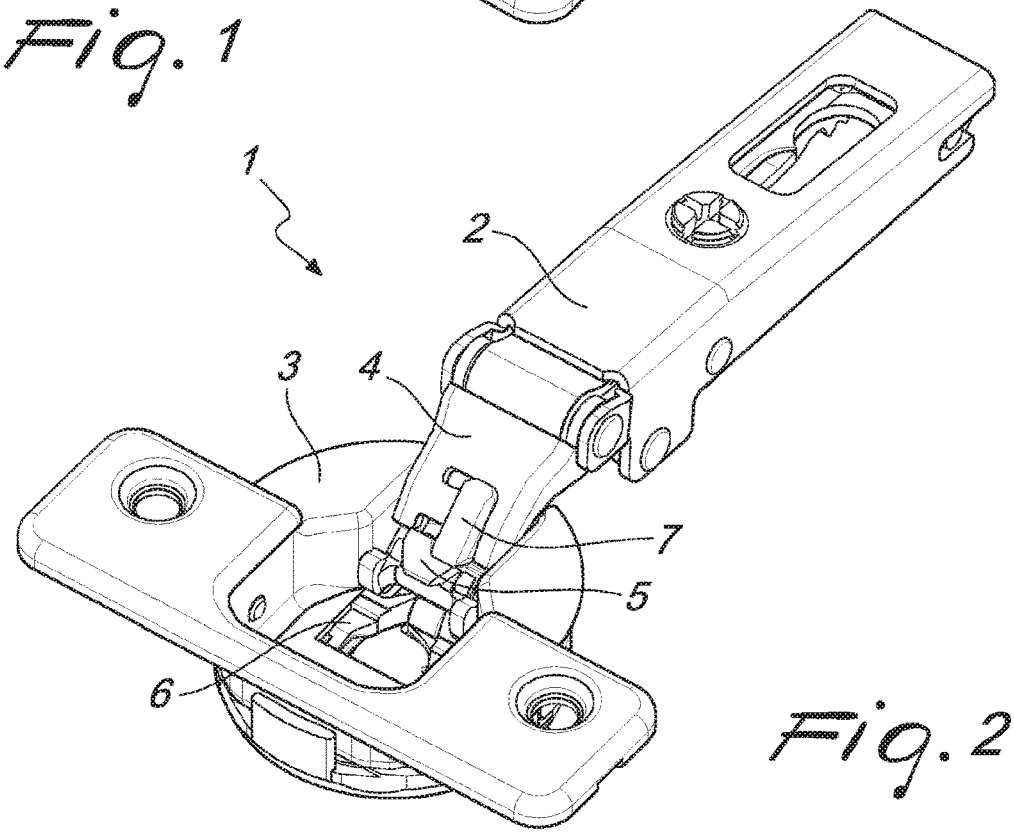
FIG. 2 is a perspective view of the hinge in FIG. 1 with the deactivation device in the position of at least partial deactivation of deceleration.
Figure 4:
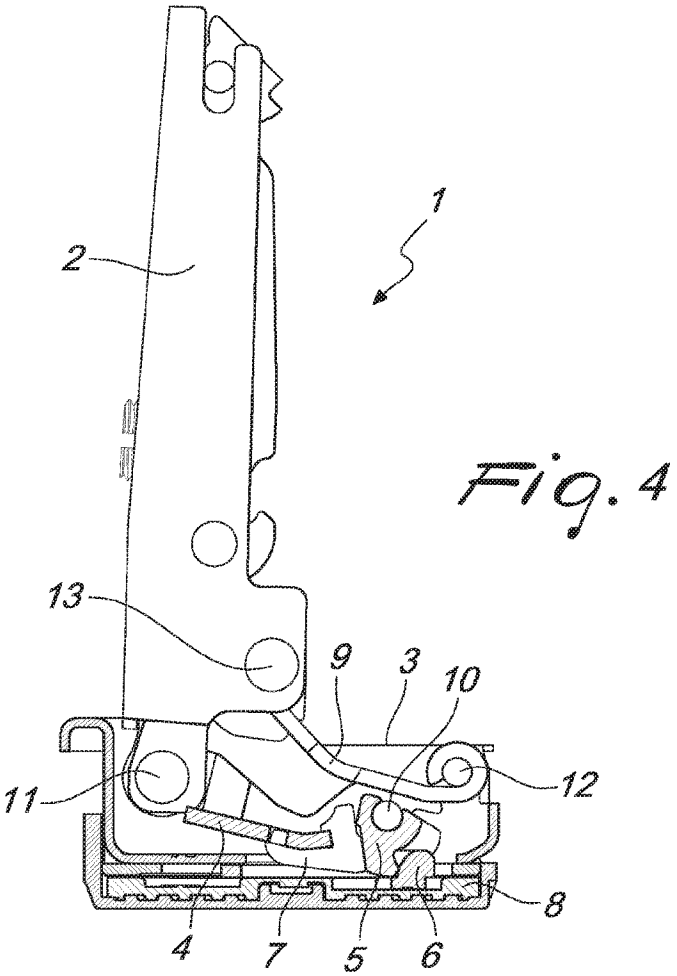
FIG. 4 is a partially cross-sectional side elevation view of the hinge in FIGS. 1 and 2, with the deceleration deactivation device in the deceleration deactivation condition.
Figure 3:
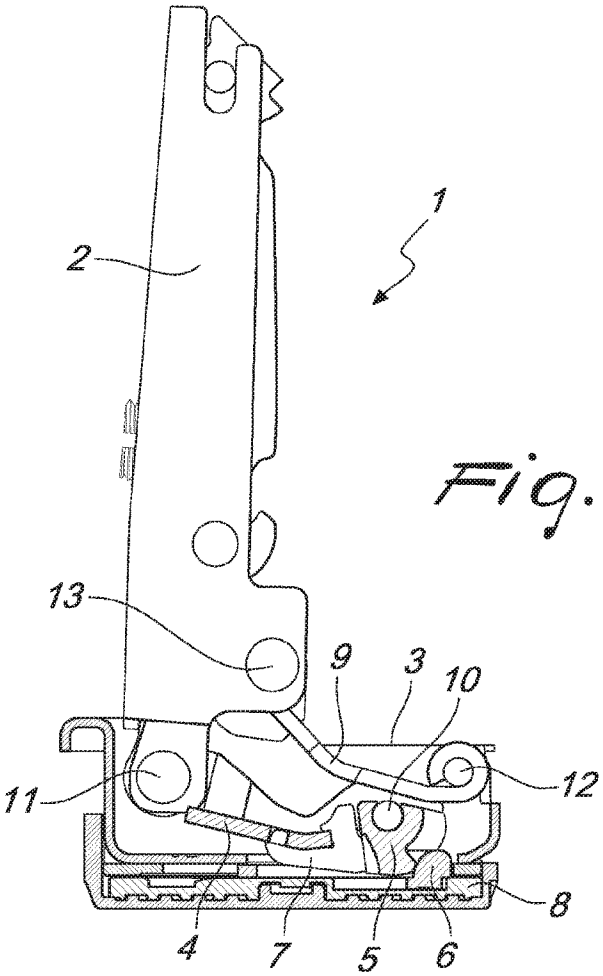
FIG. 3 is a partially cross-sectional side elevation view of the hinge in FIGS. 1 and 2, with the deceleration deactivation device in the deceleration activation condition.
Figure 5:
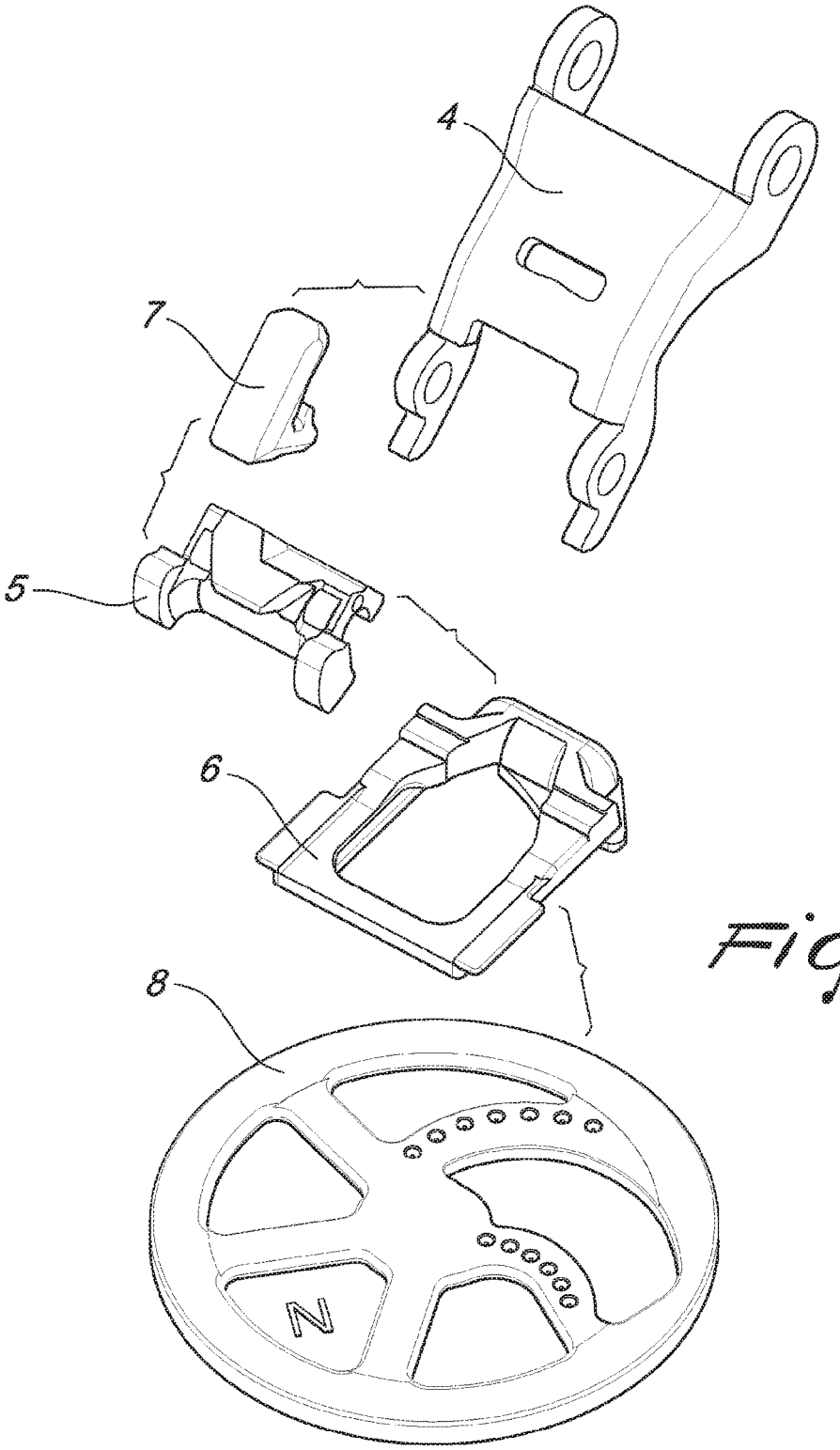
FIG. 5 is an exploded perspective view of the deceleration deactivation device according to the invention according to a first embodiment thereof.

The deactivation means 7 can be moved from a first, activation position, FIG. 1, in which the cam 5 is integral in its movement with the rocker 4, and a second, deceleration deactivation position, FIG. 2, in which the cam 5 is free to oscillate with respect to the rocker 4.

As shown in the figures, in the deactivation position, the cam 5, being free to oscillate, is not capable of driving any movement or it drives in any case only a partial movement of the slideable actuation element 6 of the deceleration disk 8, thus completely or partially deactivating the decelerating effect.

By contrast, in the activation position, because the cam 5 is integral with the rocker 4, the hinge behaves like a normal decelerated hinge, lacking the deactivation means 7 described previously.

Figure 6:
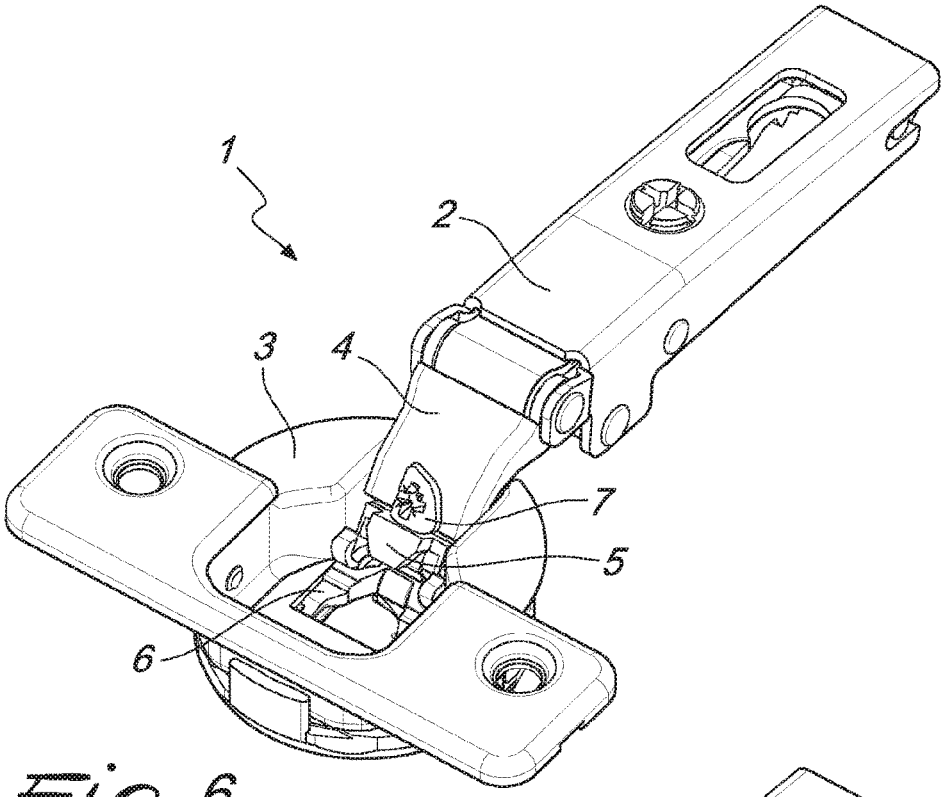
FIG. 6 is a perspective view of the hinge according to the invention with the deceleration deactivation device according to a second embodiment thereof, in the deceleration activation condition.
Figure 7:
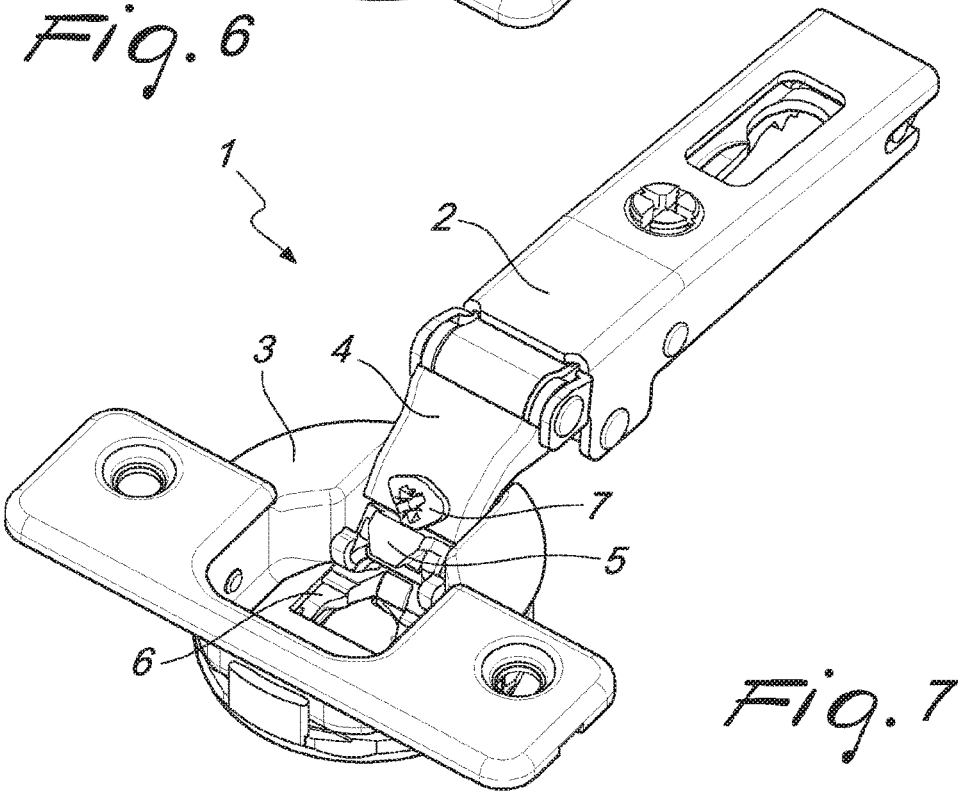
FIG. 7 is a perspective view of the hinge of FIG. 6, with the deceleration deactivation device in the condition of partial deactivation of deceleration.
Figure 8:
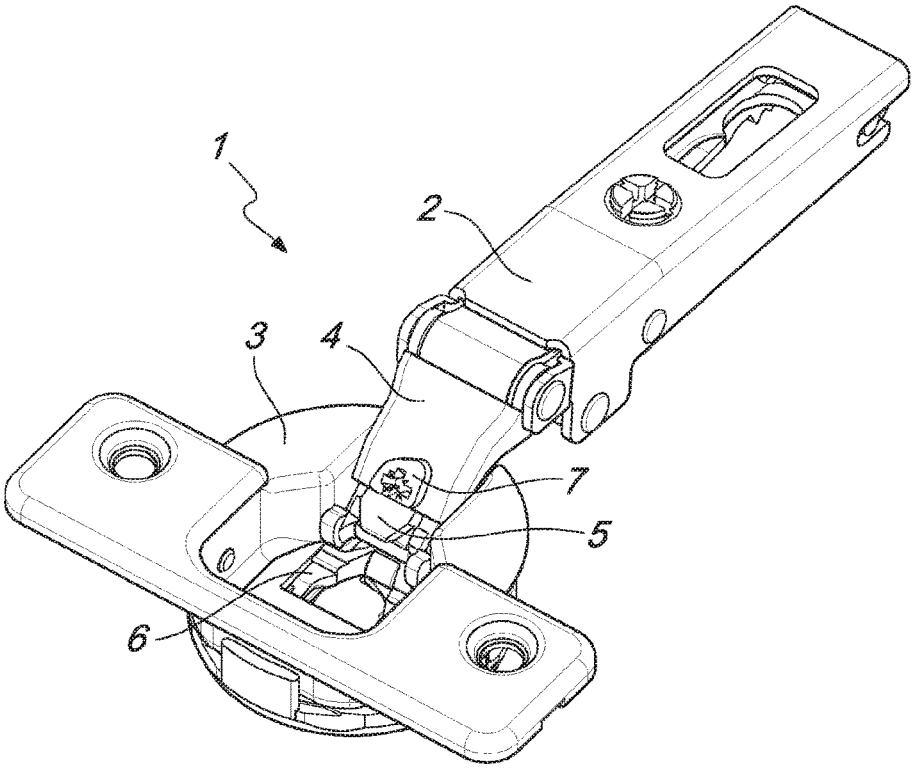
FIG. 8 is a perspective view of the hinge of FIG. 6, with the deceleration deactivation device in the deceleration deactivation condition.

FIG. 6 shows a second embodiment of the hinge according to the invention, in which the deactivation means 7 are constituted by a rotary element that is contoured so as to define a deceleration activation position, similarly to what is shown in FIG. 1, a deceleration deactivation position, shown in FIG. 8, similarly to what is shown in FIG. 2, and preferentially at least one intermediate position, FIG. 7, in which the deceleration is only partially deactivated.

Alternatively, the rotary element can have a surface that is eccentric with respect to the rotation axis of their rotary motion, so as to continuously define the position of the cam with respect to the rocker.

The deactivation means described and shown above can also be used in hinges that have a different deceleration device, for example if, in place of the deceleration disk 8 embedded in the grease, there is at least one oil-operated or fluid-operated linear decelerator, functionally connected to the slideable actuation element 6.

In practice it has been found that the hinge according to the present invention fully achieves the set aim and objects, in that it makes it possible to deactivate at least partially the deceleration device coupled to the hinge proper, so as to enable the user to decide if he/she wants the travel of the door leaf to which the hinge is applied to be decelerated or not, or be partially decelerated.

The hinge, thus conceived, is susceptible of numerous modifications and variations, all of which are within the scope of the appended claims.

Moreover, all the details may be substituted by other, technically equivalent elements.

In practice the materials employed, and the contingent dimensions and shapes, may be any according to requirements and to the state of the art.

The disclosures in Italian Patent Application No. MI2014A002227 (102014902318858) from which this application claims priority are incorporated herein by reference.

The invention claimed is:

1. A hinge with a deceleration device, comprising:

a fixed part which is configured to be connected to the body of a piece of furniture, a moveable part which is configured to be connected to a leaf of said piece of furniture, said fixed part and said movable part being mutually articulated by way of at least one connecting oscillating rocker, deceleration means being further provided which are coupled functionally to said oscillating rocker, wherein said deceleration means comprise means for at least partial deactivation of deceleration, said means for at least partial deactivation of deceleration being configured to uncouple said oscillating rocker from said deceleration means, and wherein said deceleration means comprise a deceleration element which can be actuated by a slideable actuation element, wherein said slideable actuation element can functionally mate with said rocker by way of cam means which can move with respect to said rocker, said means for at least partial deactivation of deceleration comprising an element for locking said cam means with respect to said rocker, said element for locking said cam means with respect to said rocker causing the engagement of said cam means with said rocker.

2. The hinge according to claim 1, wherein said cam means are supported so that they can oscillate on an oscillation pin between said oscillating rocker and said moveable part, said cam means being integrally connectable to said oscillating rocker.

3. The hinge according to claim 2, wherein said cam means and said oscillating rocker can be connected to each other by way of said element for locking said deactivation means.

4. The hinge according to claim 1, wherein said means for at least partial deactivation can move from a position for deactivating the deceleration element, in which said cam means oscillate freely with respect to said oscillating rocker, to a position for activating the deceleration element, in which said cam means are integrally connected to said rocker.

5. The hinge according to claim 4, wherein said means for at least partial deactivation can move through at least one intermediate position between said deceleration deactivation position and said deceleration activation position.

6. The hinge according to claim 1, wherein said deceleration means is a deceleration disk that interacts with viscous means.

7. The hinge according to claim 1, wherein said deceleration means is an oil-operated or fluid-operated linear decelerator.

8. The hinge according to claim 1, wherein said means for at least partial deactivation are configured to perform a linear translation motion transversely to said rocker.

9. The hinge according to claim 1, wherein said means for at least partial deactivation are configured to perform a rotary motion in order to pass from a deceleration deactivation position to a deceleration activation position.

10. The hinge according to claim 9, wherein said means for at least partial deactivation have at least one intermediate position between said deceleration deactivation position and said deceleration activation position.

11. The hinge according to claim 9, wherein said means for at least partial deactivation have a surface that is eccentric with respect to the rotation axis of their rotary motion.

12. A hinge with a deceleration device, comprising:

a fixed part which is configured to be connected to the body of a piece of furniture, a moveable part which is configured to be connected to a leaf of said piece of furniture, said fixed part and said movable part being mutually articulated by way of at least one connecting oscillating rocker, and deceleration means being further provided which are coupled functionally to said oscillating rocker, wherein said deceleration means comprise means for at least partial deactivation of deceleration, said means for at least partial deactivation of deceleration being configured to uncouple said oscillating rocker from said deceleration means, and wherein said means for at least partial deactivation are configured to perform a rotary motion in order to pass from a deceleration deactivation position to a deceleration activation position.

* * * * *